United States Patent [19]

Wallwork

[11] 3,967,672

[45] July 6, 1976

[54] MAKING FOUNDRY MOULDS

[76] Inventor: Charles Michael Geoffrey Wallwork, Church Cottage, Birtles Lane, Over Alderley, Cheshire, England

[22] Filed: June 26, 1975

[21] Appl. No.: 590,713

[30] Foreign Application Priority Data

June 26, 1974 United Kingdom ..... 28261/74

[52] U.S. Cl. ..... 164/181; 164/188; 164/214; 164/227; 164/403

[51] Int. Cl.[2] ..... B22C 15/02

[58] Field of Search ..... 164/181, 188, 214, 227, 164/187, 213

[56] References Cited

UNITED STATES PATENTS 3,303,535 2/1967 Rearwin et al. ..... 164/213 X

*Primary Examiner*—J. M. Meister

*Attorney, Agent, or Firm*—Scrivener Parker Scrivener and Clarke

[57] ABSTRACT

In a machine for automatically producing flaskless foundry molds by a blow squeeze method between opposed power-operated pattern plates in an opening in a slider which then moves to displace the aperture to a position in which the mold can be ejected, the slider is replaced by two sliders moving in parallel paths on opposite sides of a fixed bolster plate so that two single-sided molds are produced back-to-back, one in each slider. These may be a cope and a drag and may then be assembled together in pairs. Each slider may have two apertures and the molds may be ejected alternately on opposite sides to produce two lines of alternate copes and drags.

9 Claims, 8 Drawing Figures

37
35
33
34
29
28
25
26
27
25
30
31
24
20
21
22
22
18'
17'
2'
1'
9'

37
35
36
32
33
34
27
25
26
30
31
23
21
24
20
22
18'
17'
2'
12
11
6
4
5
39
38
9'
1'

MAKING FOUNDRY MOULDS

This invention relates to the automatic production of foundry moulds. The normal method of producing foundry moulds involves the use of flasks or boxes in which individual copes and drags are made and are then brought together in pairs. Although a considerable degree of mechanical handling of the flasks has been introduced these still involve a substantial outlay in space and have to be stored and recirculated. Proposals have been made, and indeed widely adopted, for making moulds without flasks, for example using shell-moulding techniques, and there is also our own earlier proposal forming the subject of our U.S. Pat. Spec. No. 2,871,527. In this proposal double-sided flaskless moulds are formed by a blowing technique and compacted by squeezing pressure, and then formed into lines with their mating faces vertical. Extremely high production rates are possible by this technique. However, some people feel there may be a limit to the complexity of castings that can be satisfactorily produced in moulds having a vertical parting plane.

The chief aim of the invention is to provide an improved method of making foundry moulds by a fully automatic process but with a horizontal parting plane.

According to the invention we propose to provide a pair of sliding frames, each similar to the single frame of our earlier proposal, having their planes close together and co-operating with movable pattern plates and with blowing equipment to produce single sided flaskless copes and drags back to back, one of the frames producing the copes and the other producing the drags. The copes and drags are pushed out of the respective frames onto a conveyor to form a line of mould components in the form of alternate copes and drags.

Preferably at this stage they are both already the right way up, that is to say, the drags have their parting faces uppermost and the copes have their parting faces at the bottom. This gives the opportunity for the easy placing of cores, either by machine or by hand, in the exposed cavities of the drags, and at the same time sprues can be cut in the copes. At an appropriate point along the conveyor each cope is lifted and held until the following drag moves into position beneath it, when it is lowered to form a mould which is moved to join a line of previously formed moulds, all the moulds being in contact to provide mutual support. Preferably the copes are very slightly smaller in horizontal dimensions than the drags, so that the contact takes place wholly between the drags, to avoid the risk of displacement of any cope in relation to its own drag. As further moulds are added to the end of the line the whole line is displaced along its length so that each mould progresses intermittently down the line and there is a fixed pouring point at which the metal is poured into the moulds, for example from an automatic teapot-type ladle.

There may be two conveyors, leading to two mutually independent mould lines. However, in a preferred two-conveyor arrangement the two conveyors are parallel and, after the copes have been placed on the drags, the resultant moulds from the two conveyors are pushed together to form a double line of moulds.

In a preferred version the sliding frames move horizontally and have their planes vertical. Thus the copes and drags, when they are ejected, have their parting planes vertical and they are then turned through 90°.

However it would instead be possible for the sliding frames to have their planes horizontal, which eliminates the need for turning. The rams carrying the pattern plates would then have their axes vertical.

The invention will now be further described by way of example with reference to the accompanying drawings, in which.

Figure 1:
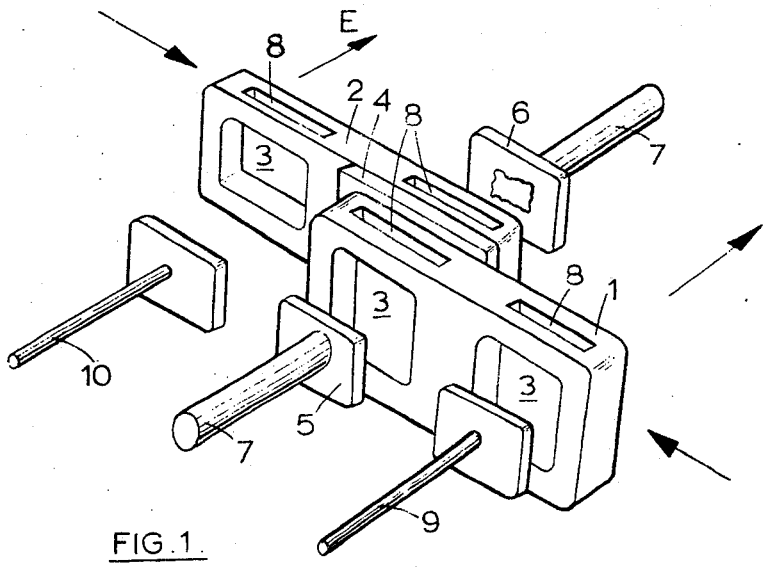
FIG. 1 is a simplified diagrammatic view illustrating the principle of the invention.
Figure 2:
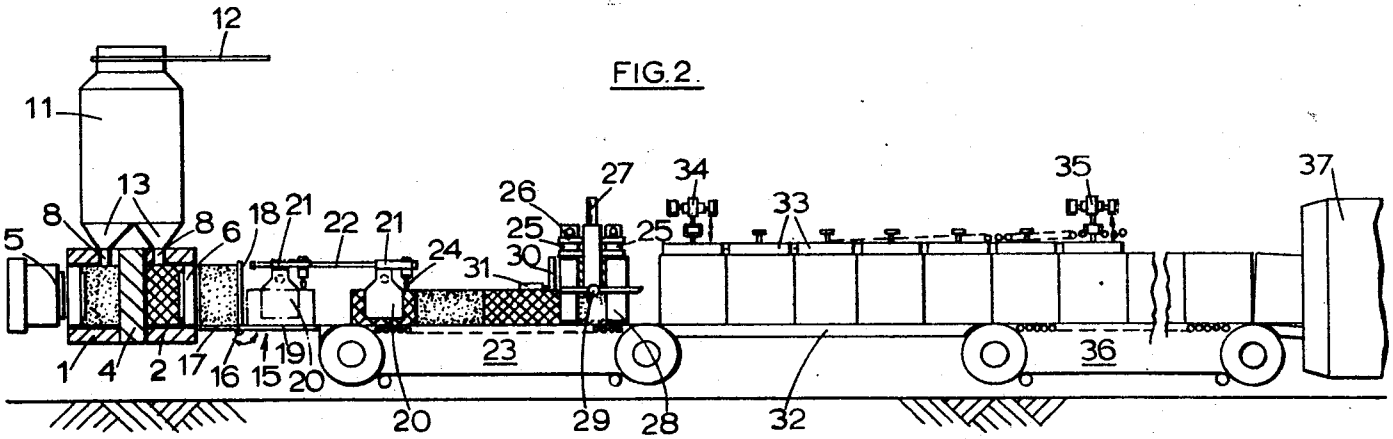
FIG. 2 is a side elevation of one form of moulding and casting installation according to the invention, designed to produce two lines of moulds.
Figure 3:
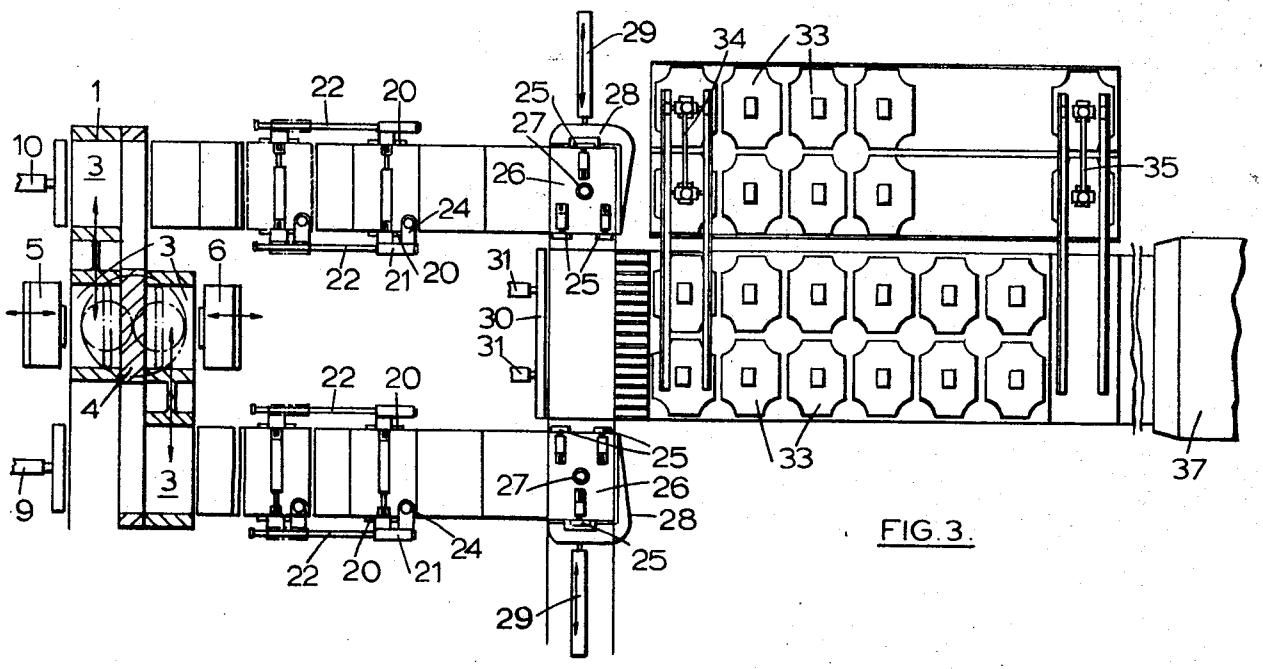
FIG. 3 is a plan view of the installation of FIG. 2.
Figure 4:
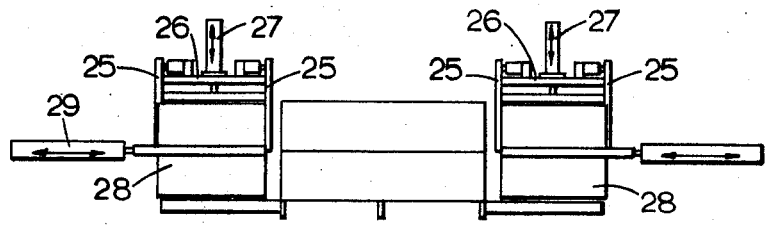
FIGS. 4, 5 and 6 are transverse sections through the installation of FIGS. 2 and 3, taken respectively on the lines A—A, B—B and C—C in FIG. 2.
Figure 5:
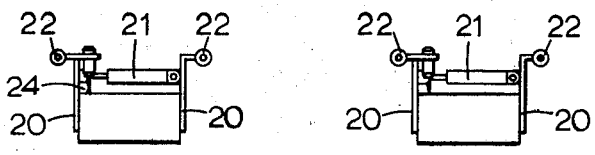
Figure 6:
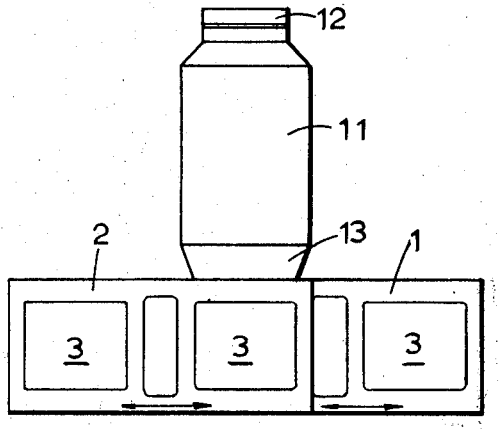

We refer first to FIG. 1 and it is necessary also to have in mind our own earlier U.S. Pat. No. 2,871,527. In the invention which formed the subject of that earlier specification flaskless moulds in the form of blocks of sand with pattern impressions in both vertical faces were formed in one of two apertures in a slider by blowing sand into the aperture while its open faces were closed by pattern plates, which then gave the mould a balanced squeeze from both sides before being withdrawn to allow the slider to move sideways to a position where the newly formed mould could be pushed out to join a line of previously formed moulds. In the meantime another mould was being formed in the other aperture, which was now between the pattern plates.

The principle of the present invention is illustrated in FIG. 1. Instead of the single slider of the earlier invention we employ two sliders 1 and 2 which, in the example shown, have their planes vertical and slide horizontally. Each slider has two apertures 3 and there is a stationary bolster plate 4 between them where they overlap. Pattern plates 5 and 6 are moved by rams 7 to enter those two apertures 3 in the two sliders which are, at a given stage in the cycle, aligned. There are inflatable seals (not shown) in the bolster plate 4 to seal it to the sliders 1 and 2. Sand is blown into both apertures through slots 8 in the top of the sliders to form two moulds, back-to-back, separated by the bolster plate 4, each mould being single-sided, that is to say, having a pattern impression in only one face.

After withdrawal of the pattern plates 5 and 6 the two sliders 1 and 2 are then simultaneously moved horizontally in opposite directions past each other until the mould formed in the slider 1 is opposite an ejector ram 9 and the mould formed in the slider 2 is opposite an ejector ram 10. Both moulds are ejected in the direction of the arrows E, whilst at the same time two further moulds are formed in the other two apertures 3, now aligned with the pattern plates, in the two sliders. The sliders then move back again and the cycle is repeated.

Normally the moulds formed in the apertures in the slider 1 will be drags, that is to the lower halves of a two-part flaskless mould, and those formed in the slider 2 will be copes, i.e. the upper halves. Thus it will be seen that each ejector ram 9 and 10 is ejecting alternately a cope, then a drag.

We refer now to FIGS. 2 to 6 which show, in somewhat simplified form, a practical installation. The two sliders 1 and 2 again have their planes vertical and move horizontally. A blowhead 11 (or it could be two separate blowheads) to which sand is fed from a hopper (not shown) in controlled quantities through a horizontally sliding sandgate 12, has two outlet nozzles 13, through which sand is blown simultaneously into the two moulding chambers, formed by the apertures 3 in the sliders, via slots 8. As in the arrangement described in our above-mentioned earlier Patent Specification, the blowhead is then lifted slightly, by means not shown, to disengage the nozzles 13 from the slots 8, before both sliders 1 and 2 are moved in opposite directions by rams (not shown), the pattern plates 5 and 6 also having first been withdrawn.

Aligned with each ejector ram 9 and 10, and on the opposite side of the sliders 1 and 2 from the ram, is a tilting table 15, capable of tilting through 90° or 180° about a horizontal axis 16 and having a shorter surface 17 and two longer surfaces 18 and 19. When a cope is ejected from the slider 2, it comes to rest between the surfaces 17 and 18, the surface 17 being just long enough to meet the face of the slider 2 so that the ram 9 or 10 is able to push the cope smoothly onto the table. The table then turns clockwise (as viewed in FIG. 2) through 90° so that the cope is now face downwards, i.e. with its pattern impression on its underside. It is gripped between jaws 20 of a carrier 21 which slides on rails 22 and transfers the cope onto the start of an intermittently moving conveyor belt 23, up against the preceding mould in that line, which is a drag.

While the cope is being transferred, a rotary sprue cutter 24 of known kind mounted on the carrier 21 cuts a sprue in the upper face of the cope. Alternatively the pouring basin could have been formed during blowing of the cope by the incorporation, in the bolster plate 4, of a withdrawable basin-forming pattern which retracts before movement of the slider 2.

The table then swings back through 180° and as the slider 2 is now clear, having moved to its other end position, the longer surface 18 is able to bridge the gap left by the slider 2 so that a drag now ejected from the slider 1 by the ram 9 or 10 can move smoothly onto it and lie between the surfaces 18 and 19. Again the table turns clockwise through 90° and this brings the drag to a position in which its parting face, i.e. the face which carries the pattern impression, is uppermost. Like the cope before it, the drag is now picked up by the jaws 20 and transferred to the conveyor belt 23, which has in the meantime carried the cope forward to leave room for it. While the drag is being transferred the sprue cutter 24 is not used.

Each time a cope mould reaches the end of the conveyor 23 jaws 25 on a lifting plate 26 come in from opposite sides and grip it, then a ram 27 lifts the plate, and the cope with it, vertically upwards. As the cycle continues the conveyor 23 then brings the following mould, which is a drag, beneath it and the two moulds are brought into accurate mutual alignment by the fact that they both engage two mutually perpendicular vertical surfaces of an L-shaped locating body 28. The cope is now lowered onto the drag. A ram 29, acting on the body 28, then pushes the pair of moulds, now forming a mould assembly, laterally towards the centre-line of the installation. There are two lines of mould assemblies being formed simultaneously and at this stage the two lines come into contact, side by side.

A pusher 30, actuated by rams 31, now pushes both assemblies simultaneously onto a horizontal track 32, on which the two lines are carried along forwards, being indexed along by a distance equal to the length of one mould each time a new pair of mould assemblies is added to the end of the line.

At this stage weights 33 are loaded onto the tops of the mould assemblies in accordance with normal foundry practice, the weights being picked up from a storage area by a carriage 34. Metal is poured into the moulds in any known manner, either by tilting ladles or by automatic methods, such as so-called teapot ladles. When the castings have solidified sufficiently the weights are lifted off by a carriage 35 and returned to the storage area for re-use. During their advance, the mould assemblies have moved from the track 32 onto a further conveyor 36 to cool. When they reach the end of this they fall off into a rumbling barrel 37 where they are broken up and the castings are shaken out while the sand is extracted for recycling, as in the process described in our above-mentioned earlier specification.

It will be understood that the whole installation, apart from the metal pouring and the shake-out, operates intermittently in step with the formation of the moulds and the movements of the sliders 1 and 2. The rams are mostly hydraulic and their operation in the correct sequence is controlled by solenoid-operated valves with appropriate timers and interlocks, limit switches being used to detect completion of the various movements. Such details are well understood by those skilled in the field of automatic control and it is not felt necessary to describe them here. Certain of the features described in the specification of our other British application No. 28262/74 filed simultaneously with the present one may be used with advantage in the installation described above.

While the copes and drags are on the conveyor 23 the drags have their parting faces exposed, giving ample time for the insertion of even complex cores, either automatically or by hand.

The installation shown in FIGS. 2 to 6 has the advantage that each mould assembly on the twin track is supported by adjacent moulds on three sides. Although not shown, there could be some form of support on the fourth side of each mould as well, for example by means of spring-loaded supported bars pressing against opposite sides of the double line of moulds during pouring of the metal. This enables the moulds for a given weight of casting to be made smaller than would otherwise be necessary, and it gives a saving in sand.

In a modified arrangement the moulds in each of the two lines take the same two faces, e.g. the back face and the right-hand face, as the datum faces for locating the cope and drag with respect to each other and in that case, both L-shaped bodies 28 will face the same way, and the two lines of mould assemblies will have a gap between them.

Figure 8:
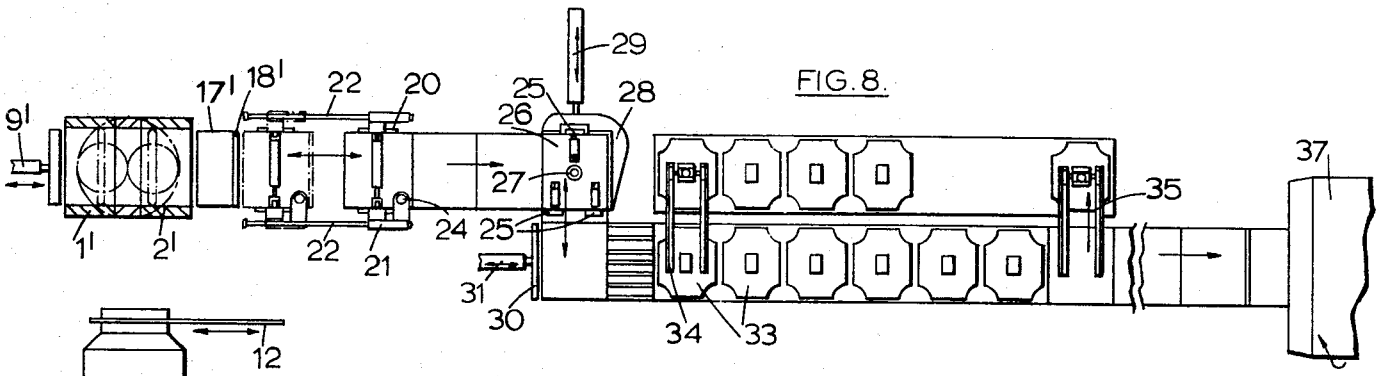
FIGS. 7 and 8 are views corresponding to FIGS. 2 and 3 but showing a second embodiment, in which only a single line of moulds is produced.
Figure 7:
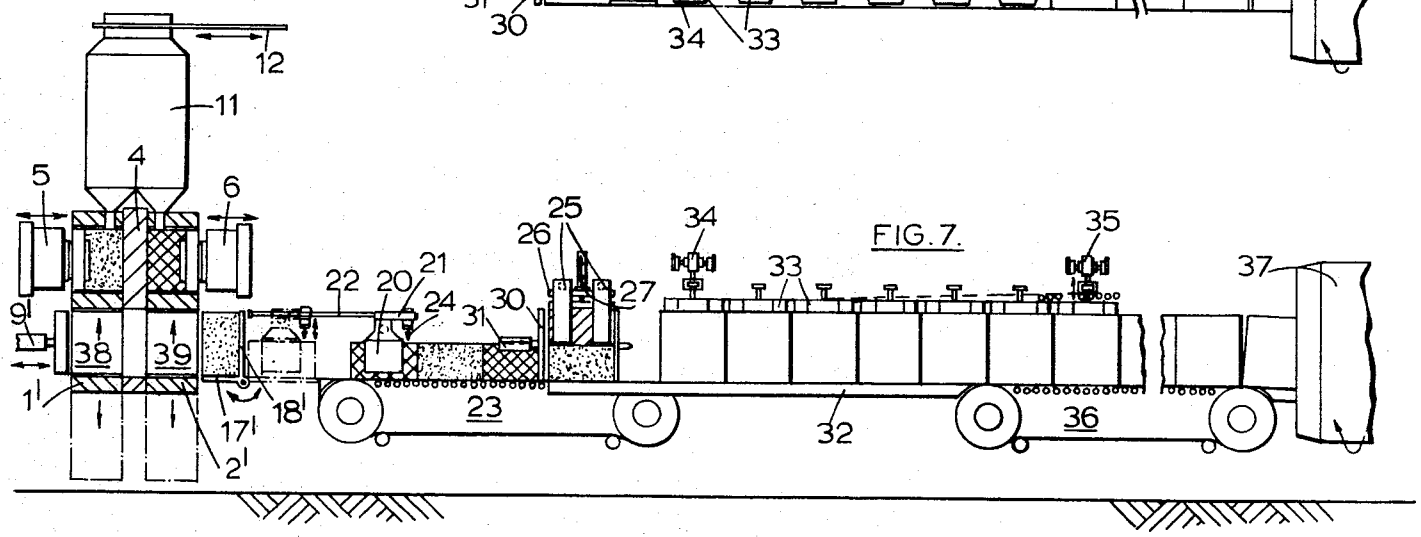

Whereas in the process described in our above-mentioned earlier Patent Specification the moulds were bonded with sodium silicate, hardened with carbon dioxide, we now find that this is not necessary and flaskless moulds of adequate strength for the present invention can be made from straightforward green sand, bonded simply by the compaction achieved by the squeeze from the rams 5 and 6.

Where one requires a lower output than can be obtained with the twin-track installation shown in FIGS. 2 to 6, a simpler version could be used, shown in FIGS. 7 and 8. Reference numerals are the same, where applicable. There are still two sliders, but now each slider 1' and 2' has only a single aperture 3' forming a mould chamber and furthermore each slider moves vertically instead of horizontally between its two end positions. It is true that each slider does still have a second aperture, but not to form a moulding chamber. The aperture 38 in slider 1' is present to allow the single ejector ram 9' to pass through that slider in order to push the newly formed cope out of the aperture 3' in the other slider 2'. Likewise the aperture 39 in the slider 2' allows a drag formed in the slider 1' to be ejected through the slider 2', and the aperture acts as a guide for the drag during this movement. The tilting table now only requires two walls 17' and 18' and moves back and forth through 90° . The remainder of the installation corresponds exactly to one half that of FIGS. 2 to 6. Instead of the simplified table shown in FIGS. 7 and 8 one could use the same table 15 as in that other version.

Within the scope of the invention one could employ twin sliders of FIGS. 7 and 8 but moving horizontally as in FIGS. 2 to 6. Indeed it would be possible to turn the installation of FIGS. 2 to 6 on its side, so that its sliders moved vertically, delivering alternate copes and drags to each of two vertically spaced tables. A still further possibility is for the sliders to be turned on their sides so that the axes of the apertures are vertical, with the drag pattern plate moving vertically downwards into the upper aperture and the cope pattern plate moving upwards into the lower aperture. The resulting copes and drags do not then have to be turned through 90°, but they still need to be interchanged, i.e. the cope has to be moved to a position above the drag, and there are other problems which do not arise in the vertical-faced layouts described above.

I claim:

1. A machine for automatically producing flaskless foundry moulds comprising two sliders, each provided with at least one aperture open to both faces of the sliders, said sliders being mounted to reciprocate along parallel paths, a stationary bolster plate between said sliders, said sliders being placed so that in one position of said sliders one aperture in one slider is in alignment with that of the other slider but separated from it by said bolster plate, and two power-operated platens carrying respective pattern plates and adapted to cause said pattern plates to enter said aligned apertures to define respective moulding chambers, means for blowing sand into said chambers to form flaskless single-sided moulds back-to-back, one of said moulds being a cope and the other being a co-operating drag, and ejector ram, said sliders both being movable along the said parallel paths to positions where said ejector ram is able to push the resultant mould out said aperture for subsequent handling.

2. The machine set forth in claim 1 wherein each said slider has two apertures each forming moulding chambers and said sliders are movable simultaneously in opposite directions, and a second ejector ram whereby moulds formed in one of said apertures in each said slider are ejectable simultaneously on opposite sides of said bolster plate.

3. The machine set forth in claim 1 wherein said bolster plate lies in a vertical plane.

4. The machine set forth in claim 3 wherein said two sliders are adapted to reciprocate vertically.

5. The machine set forth in claim 4 wherein each said slider has only one aperture forming a moulding chamber and is movable between an upper position in which said aperture is aligned with an associated one of said pattern plates and a lower position in which said aperture is aligned with said ejector ram.

6. The machine set forth in claim 1 wherein each said slider has two said apertures and said sliders are movable simultaneously in opposite directions whereby, while a first one of said apertures in each said slider is aligned with the said bolster plate, the second aperture on one slider lies on one side of said bolster plate and is aligned with said ejector ram whereas the second aperture in the other slider has on the opposite side of said bolster plate from second aperture in said one slider, there being a second ejector ram aligned with the position then occupied by said second aperture in said other slider.

7. A machine for producing flaskless foundry moulds, said machine comprising a first elongated slider having opposed faces and having first and second apertures therein spaced apart in the direction of longitudinal extent of said slider and each extending between said faces, said slider being movable in the direction of its length between first and second positions, a second elongated slider similar to said first slider and likewise having opposed faces and having third and fourth apertures therein spaced apart in the direction of the length of said second slider and said second slider being movable in the direction of its length between third and fourth positions, a stationary bolster plate, the paths of movement of said first and second sliders being parallel to the plane of said bolster plate and on opposite sides thereof, and said sliders occupying said first and third positions simultaneously, in which positions said first and third apertures are in mutual alignment and on opposite sides of said bolster plate to define aligned moulding chambers, while said second and fourth apertures lie clear of said bolster plate and on mutually opposite sides of the region of said moulding chambers, said sliders being movable simultaneously to said second and fourth positions in which said second and fourth apertures then lie in mutual alignment on opposite sides of said bolster plate to define aligned moulding chambers while said first and third apertures lie clear of said bolster plate and on mutually opposite sides of the region of said moulding chambers, first and second movable pattern plates, said pattern plates lying on opposite sides of said bolster plate and being movable towards said bolster plate by power means whereby said first pattern plate enters the moulding chamber in said first slider and said second pattern plate enters the moulding chamber in said second slider, sand blowing means adapted to blow sand into said blowing chambers, and first and second ejector means, said first ejector being adapted to eject moulds, formed in said chambers, from said first and third apertures in the second and fourth positions of said sliders respectively and said second ejector means being adapted to eject moulds from said second and fourth apertures in the first and third positions of said sliders.

8. A machine for automatically producing flaskless foundry moulds, said machine comprising a first slider having a first aperture therethrough, a second slider having a second aperture therethrough, a bolster plate, said first and second sliders each being reciprocable on parallel paths on opposite sides of said bolster plate between first positions in which said apertures are aligned with said bolster plate and second positions in which said apertures are clear of said bolster plate, opposed aligned power-operated first and second pattern plates movable towards opposite sides of said bolster plate and adapted to enter said apertures respectively to define moulding chambers, sand-blowing means adapted to blow sand into said moulding chambers to form therein single-sided moulds back to back, and ejector means aligned with said second positions of said apertures to eject moulds therefrom.

9. The machine set forth in claim 8 wherein said apertures extend horizontally and including tilting table means adapted to turn moulds ejected from each of said apertures through 90° about a horizontal axis in the same directions whereby moulds formed in said first aperture then have their parting faces down whereas moulds formed in said second aperture then have their parting faces uppermost.

* * * * *